US008265836B2

(12) United States Patent
Yamada et al.

(10) Patent No.: US 8,265,836 B2
(45) Date of Patent: Sep. 11, 2012

(54) LOAD WEIGHT MEASURING DEVICE FOR A MULTI-STAGE MAST FORKLIFT TRUCK

(75) Inventors: Tadashi Yamada, Kariya (JP); Toshinari Fukatsu, Kariya (JP); Hidenori Oka, Kariya (JP); Kunio Maki, Kariya (JP); Shigenori Iwase, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 384 days.

(21) Appl. No.: 12/468,496

(22) Filed: May 19, 2009

(65) Prior Publication Data

US 2009/0292427 A1 Nov. 26, 2009

(30) Foreign Application Priority Data

May 26, 2008 (JP) ..... 2008-137237

(51) Int. Cl.
*B66F 9/08* (2006.01)
*B66F 9/22* (2006.01)

(52) U.S. Cl. ..... 701/50; 187/394; 187/274; 187/275; 187/230; 187/234; 187/236; 187/238; 187/251; 414/631; 702/174

(58) Field of Classification Search ..... 701/50; 187/398, 394, 282, 283, 257, 274, 275, 281, 187/222, 223, 224, 226, 230, 233, 234, 236, 187/238, 251, 303, 304; 177/139; 414/631, 414/632, 633, 634, 635, 636, 637, 638; 702/174; *B66F 17/00, 9/08, 9/22, 9/24*
See application file for complete search history.

(56) References Cited

U.S. PATENT DOCUMENTS 4,942,529 A 7/1990 Avitan et al.
5,238,086 A 8/1993 Aoki et al.
5,666,295 A 9/1997 Bruns
(Continued)

FOREIGN PATENT DOCUMENTS

JP 62-36300 A 2/1987
(Continued)

OTHER PUBLICATIONS

European Search Report for Application No. 09159498.6-1256, dated Sep. 10, 2009.

*Primary Examiner* — Paul N Dickson
*Assistant Examiner* — Keith Frisby
(74) *Attorney, Agent, or Firm* — Locke Lord LLP

(57) ABSTRACT

A load weight measuring device for a multi-stage mast fork-lift truck has a mast assembly, an oil passage, a flow regulator valve, a pressure sensor, a detecting device, a memory, a selector, and a calculator. The mast assembly has a lift bracket for receiving a load weight, a multi-stage mast unit having masts, and a multi-stage lift cylinder unit having lift cylinders each having an oil chamber for raising the lift bracket along the masts. Hydraulic oil flows in the oil passage. The pressure sensor detects a pressure of hydraulic oil and outputs a pressure signal. The detecting device detects a state which stage of the lift cylinder raises the lift bracket and outputs a detection signal. The memory stores predetermined parameters from which the selector selects the parameter based on the detection signal. The calculator calculates the load weight based on the selected parameter and the pressure signal.

7 Claims, 16 Drawing Sheets

U.S. PATENT DOCUMENTS

| | | | | |
|---|---|---|---|---|
| 6,269,913 | B1 | 8/2001 | Kollmannsberger et al. | |
| 6,296,081 | B1 | 10/2001 | Nagai et al. | |
| 7,010,404 | B2 * | 3/2006 | Ichijo et al. | 701/50 |
| 7,219,769 | B2 * | 5/2007 | Yamanouchi et al. | 187/227 |
| 7,896,358 | B2 * | 3/2011 | Hoff | 280/5.5 |
| 2004/0158380 | A1 | 8/2004 | Farber et al. | |

FOREIGN PATENT DOCUMENTS

| | | | |
|---|---|---|---|
| JP | 63-165298 | A | 7/1988 |
| JP | 10-265194 | A | 10/1998 |
| JP | 2000-016795 | A | 1/2000 |

* cited by examiner

LOAD WEIGHT MEASURING DEVICE FOR A MULTI-STAGE MAST FORKLIFT TRUCK

BACKGROUND OF THE INVENTION

The present invention relates to a load weight measuring device for a multi-stage mast forklift truck.

A forklift truck includes a mast assembly having a mast unit, a lift bracket, forks attached to the lift bracket, and a lift cylinder unit for raising the lift bracket along the mast unit. There has been a demand for measuring the weight of a load while the load is being lifted by the forks. When the forklift truck is traveling with a load raised to a high position by the forks, various controlling operations are performed corresponding to the weight of the load in order to secure the stability of the forklift truck. A load weight measuring device used for such purpose is disclosed in Japanese Patent Application Publications No. 2000-16795 and No. 10-265194.

The load weight measuring device disclosed in the above-indicated Publications includes a mast assembly. Referring to FIGS. 14 and 15 showing the conventional forklift truck according to the above-indicated Publications, the mast assembly 100 has a multi-stage mast unit including outer masts 90 supported by a body frame, and inner masts 92 vertically guided by the outer masts 90 for vertically guiding and moving a lift bracket 91. The mast assembly 100 has a lift cylinder unit having a pair of left and right lift cylinders 93, 94. As shown in FIG. 16, respective lift cylinders 93, 94 have cylinder bodies 93A, 94A fixed to the outer masts 90, oil chambers 93B, 94B formed in the cylinder bodies 93A, 94A and piston rods 93C, 94C fixed to the inner masts 92 and extendable from the cylinder bodies 93A, 94A. As shown in FIGS. 14 and 15, a pair of chain wheels 95 is mounted to the top of respective inner mast 92, and a pair of chains 96 is wound around the respective chain wheels 95. One end of the chains 96 are fixed to the outer masts 90, and the other end of the chains 96 are fixed to the lift bracket 91.

As shown in FIG. 16, the oil chambers 93B, 94B are connected to each other through an oil passage 97, which is connected to a flow regulator valve 98 for regulating the maximum flow rate of hydraulic oil. A pressure sensor 99 is disposed in the oil passage 97 for detecting the pressure of hydraulic oil. Reference numerals 80, 81, 82, 83 and 84 designate a hydraulic pump, an oil control valve, a drain passage, an oil tank, and a safety down valve, respectively.

The forklift truck further includes a controller having therein a memory and a calculator that form a part of the load weight measuring device. Since the mast assembly 100 has the single-stage lift cylinder unit having one pair of the lift cylinders 93, 94, the memory stores parameters only for the single-stage lift cylinder unit.

According to the forklift truck having such a load weight measuring device, when the lift cylinders 93, 94 of the mast assembly 100 are operated by the forklift truck operator so as to extend the piston rods 93C, 94C, the inner masts 92 are raised by the lift cylinders 93, 94 while the inner masts 92 are guided by the outer masts 90. Accordingly, the lift bracket 91 is raised at double speed, or at a speed that is twice as much as the speed at which the inner masts 92 are raised while the lift bracket 91 is guided by one inner mast 92. Load weight acting on the lift bracket 91 is transmitted to the hydraulic oil in the oil chambers 93B, 94B of the lift cylinders 93, 94, and hydraulic pressure in the oil chambers 93B, 94B is detected by the pressure sensor 99. The calculator calculates the load weight acting on the lift bracket 91 based on a pressure signal outputted from the pressure sensor 99 and the parameters stored in the memory. The data of calculated load weight is used for various purposes, such as displaying the value of calculated load weight on a display device, providing a warning signal when the calculated load weight exceeds a predetermined value, and controlling of the forward-tilting angle of the mast assembly 80 and the traveling speed of the forklift truck.

The above-described conventional load weight measuring device is used for a forklift truck having a mast assembly with a single-stage lift cylinder unit. If this load weight measuring device is used for a forklift truck having a mast assembly with a double-stage or multi-stage lift cylinder unit, the load weight measuring device cannot always measure the load weight correctly.

There are various types of mast assemblies, such as a mast assembly having a two-stage mast unit and a single-stage lift cylinder unit, a mast assembly having a two-stage mast unit and a two-stage lift cylinder unit, and a mast assembly having a three-stage mast unit and a two-stage lift cylinder unit. For example, there is a mast assembly having a two-stage mast unit and a two-stage lift cylinder unit, in which oil chambers of the lift cylinders of each stage are connected to each other in series from the flow regulator valve toward the downstream with respect to the direction in which hydraulic oil flows, and the lift cylinder having the oil chamber of the second stage is operated thereby to extend its piston rod firstly. This type of mast assembly is called a full free lift mast assembly. The full free lift mast assembly is operatable in such a manner that the lift bracket is raised firstly to the level of the top end of the inner masts while the inner masts of the second stage remains at its lowered position without moving up relative to the outer masts of the first stage, and then the inner masts are raised to the level of the top end of the outer masts. A forklift truck having such a full free lift mast assembly has some advantage when the forklift truck is used in a place whose ceiling is not sufficiently high. That is because the full free lift mast assembly enables the forklift truck to perform the operation of loading without causing a collision between the mast of the forklift truck and the ceiling. In the forklift truck having a full free lift mast assembly, the load weight acting on the lift bracket can be calculated by the load weight measuring device based on the parameters for the first-stage mast unit in the low lift stage of the mast assembly when the inner masts is not raised relative to the outer masts, and the lift bracket is raised relative to the inner masts. Meanwhile, in the high lift stage of the mast assembly when the inner masts are raised relative to the outer masts, the parameters for the first-stage mast is not appropriate for the high lift state, so that correct calculation of the load weight cannot be accomplished. Therefore, the value of the load weight shown on the display is incorrect, a warning signal is provided incorrectly, and the controlling of the forklift truck operation cannot be accomplished appropriately. This is true of a forklift truck having a mast assembly with a three-stage mast unit and a two-stage lift cylinder unit.

The mast assembly having a multi-stage mast unit and a multi-stage lift cylinder unit is a so-called full free mast assembly, such as a FV mast assembly, a FW mast assembly, a FSV mast assembly and an FSW mast assembly. As shown in Table 1, the FV mast assembly has a two stage lift cylinder unit having one pair of first lift cylinders and one second lift cylinder. The FW mast assembly has a two-stage lift cylinder unit having two pairs of first lift cylinders and second lift cylinders. The FSV mast assembly has a two-stage lift cylinder unit having one pair of first lift cylinders and one second lift cylinder. The FSW mast assembly has a two-stage lift cylinder unit having two pairs of first lift cylinders and second lift cylinders. Meanwhile, the V mast assembly having a two-stage mast unit and a single-stage lift cylinder unit is not the full free mast assembly.

TABLE 1

| Mast assembly type | Number of first lift cylinder | Number of second lift cylinder | Lift cylinder operated in the low lift state | Lift cylinder operated in the high lift state |
|---|---|---|---|---|
| FV | 2 | 1 | Second | First |
| FW | 2 | 2 | Second | First |
| FSV | 2 | 1 | Second | First |
| FSW | 2 | 2 | Second | First |
| V | 2 | None | First | First |

When the load weight measuring device is used for the mast assembly with the multi-stage lift cylinder unit, a detecting device detects a state which stage of the lift cylinder raises the lift bracket, then a selector is actuated to select parameters from the predetermined parameters to be used by a calculator, and the calculator can calculate the load weight based on the parameters for the detected stage lift cylinder unit.

The present invention which has been made in light of the above problems is directed to providing a load weight measuring device which is adapted for use in a multi-stage mast forklift truck having a mast assembly with a multi-stage lift cylinder unit having lift cylinders, and which can always measure the load weight correctly.

SUMMARY OF THE INVENTION

In accordance with the present invention, a load weight measuring device for a multi-stage mast forklift truck has a mast assembly, an oil passage, a flow regulator valve, a pressure sensor, a detecting device, a memory, a selector, and a calculator. The mast assembly has a lift bracket for receiving a load weight, a multi-stage mast unit having masts, and a multi-stage lift cylinder unit having lift cylinders each having an oil chamber for raising the lift bracket along the masts. Hydraulic oil flows in the oil passage. The flow regulator valve is connected to the oil chamber of the lift cylinder through the oil passage for regulating the maximum flow rate of hydraulic oil. The pressure sensor detects a pressure of hydraulic oil and outputs a pressure signal. The detecting device detects a state which stage of the lift cylinder raises the lift bracket and outputs a detection signal. The memory stores predetermined parameters for calculating the load weight. The selector selects one or more parameters from the predetermined parameters based on the detection signal. The calculator calculates the load weight based on the selected parameter and the pressure signal.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

The following will describe the forklift truck having a load weight measuring device according to a first preferred embodiment of the present invention with reference to FIGS. 1 through 8.

Figure 1:
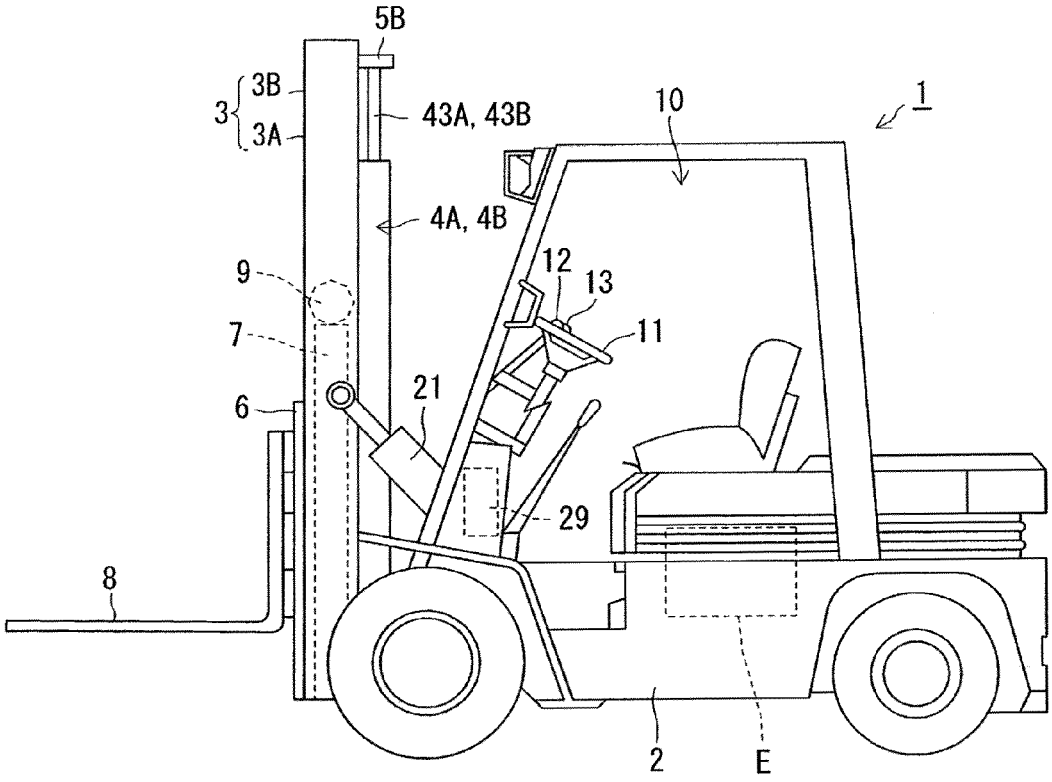
FIG. 1 is a side view of a forklift truck according to a first preferred embodiment of the present invention.
Figure 2:
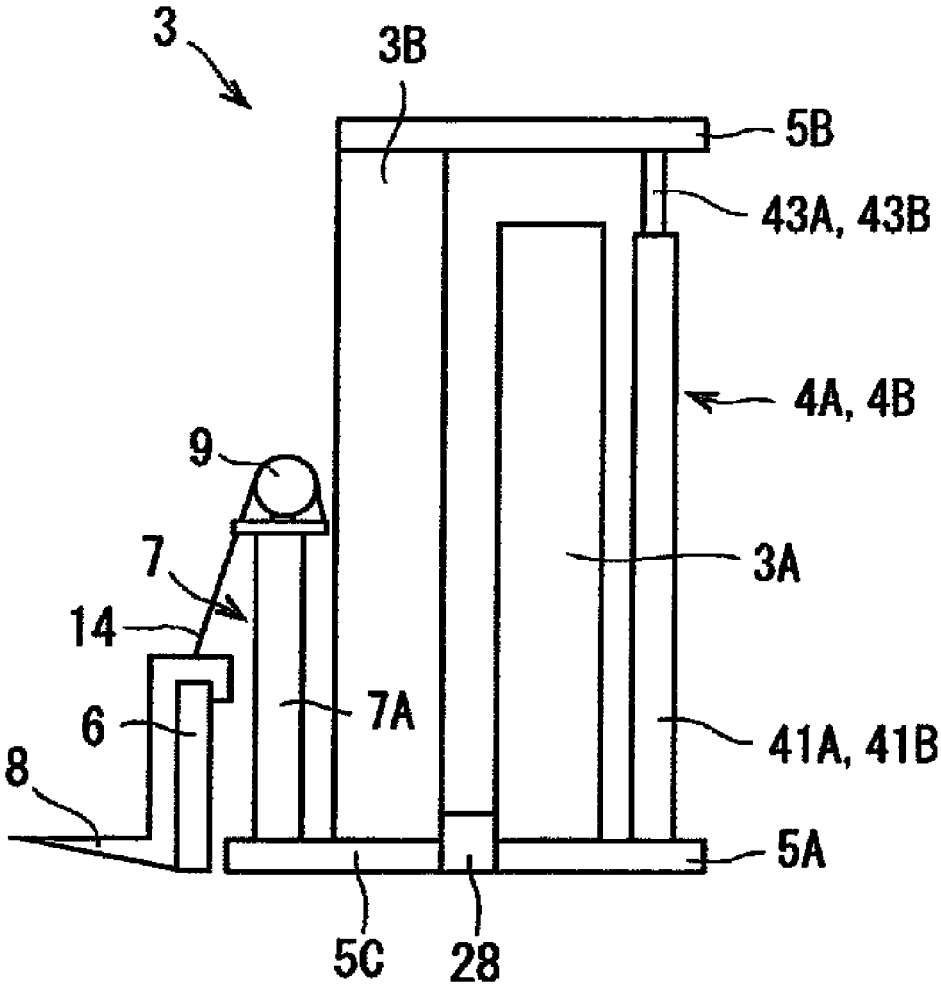
FIG. 2 is a schematic side view of a mast assembly of the forklift truck of FIG. 1.
Figure 3:
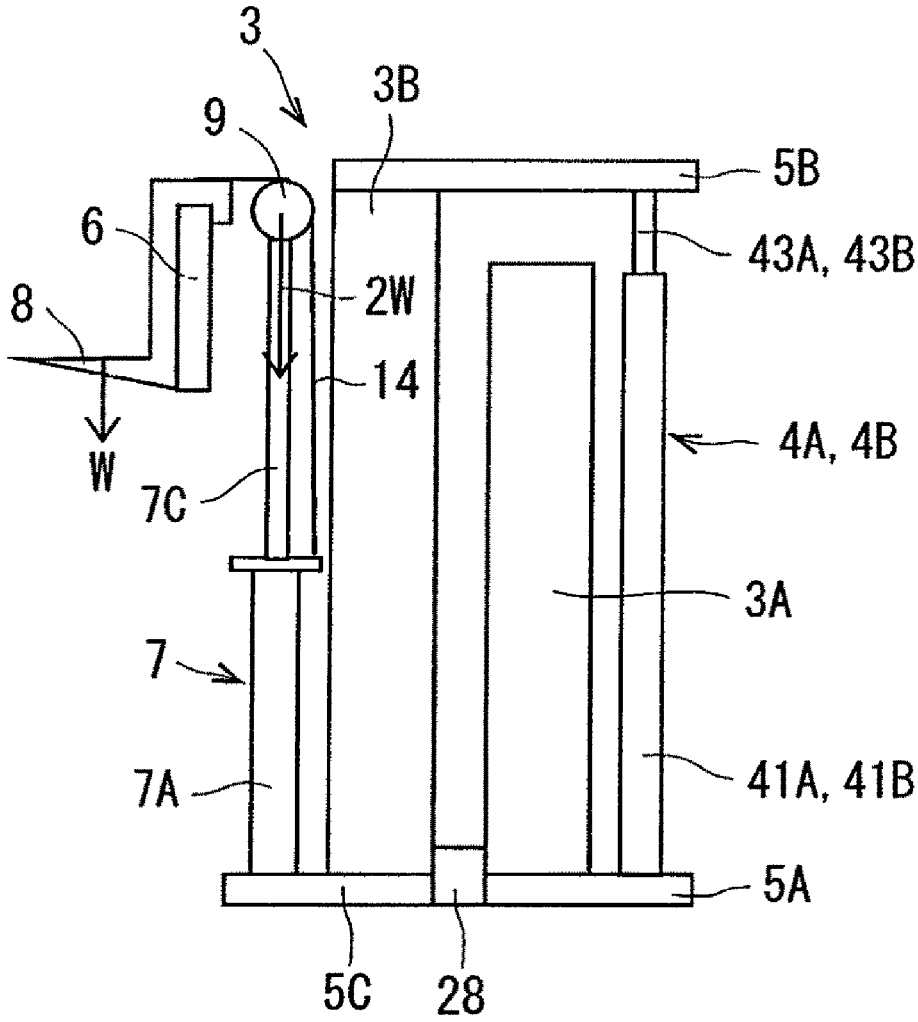
FIG. 3 is a schematic side view of the mast assembly of FIG. 2 in a different state.
Figure 4:
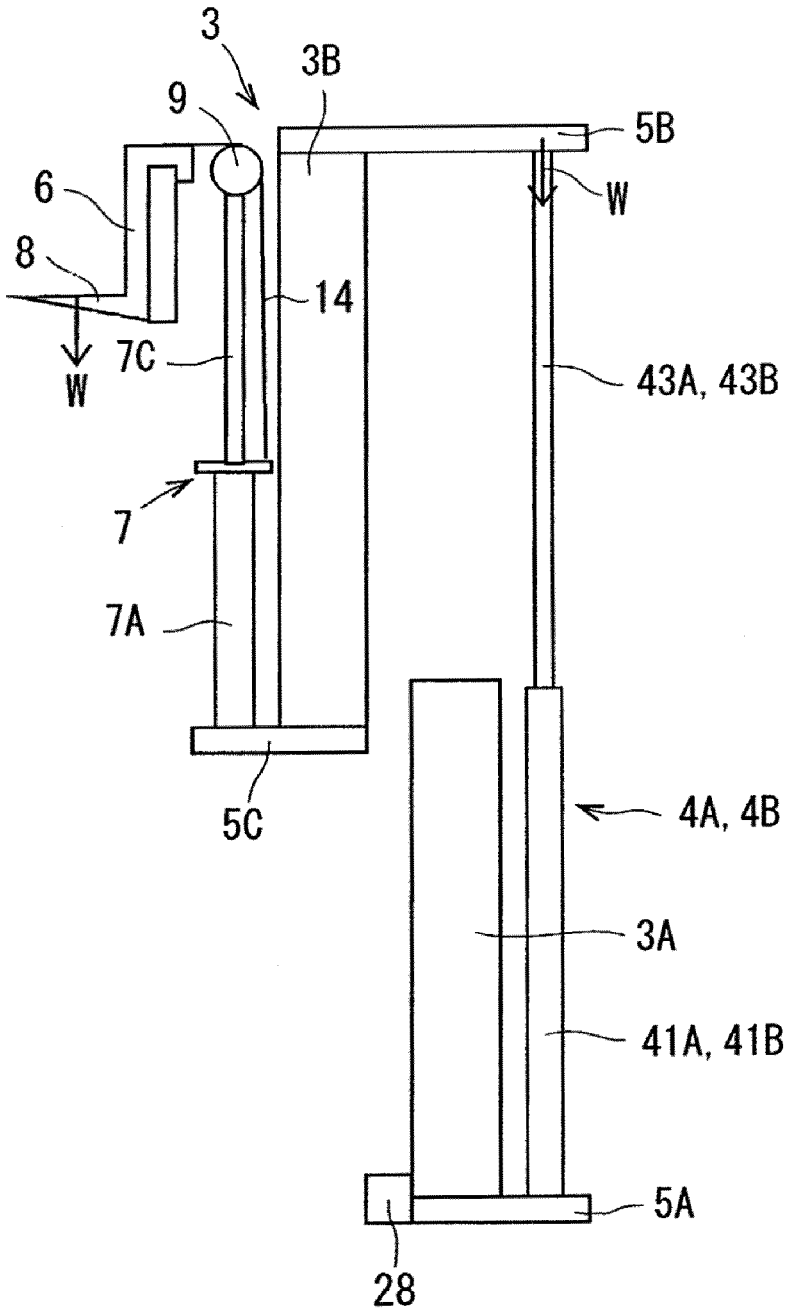
FIG. 4 is a schematic side view of the mast assembly of FIG. 2 in a still different state.

Referring to FIG. 1, a forklift truck 1 has a body frame 2 and an FV mast assembly 3 disposed upright in the front of the body frame 2. Referring to FIGS. 2 through 4, the FV mast assembly 3 has a pair of left and right outer masts 3A (only one outer mast being shown), and a pair of left and right inner masts 3B (only one inner mast being shown). A pair of outer masts 3A is supported tiltably in the longitudinal direction of the body frame 2, and guides the inner masts 3B for moving vertically. The inner masts 3B guide a lift bracket 6 for moving vertically. The lift bracket has a pair of left and right forks 8.

Figure 5:
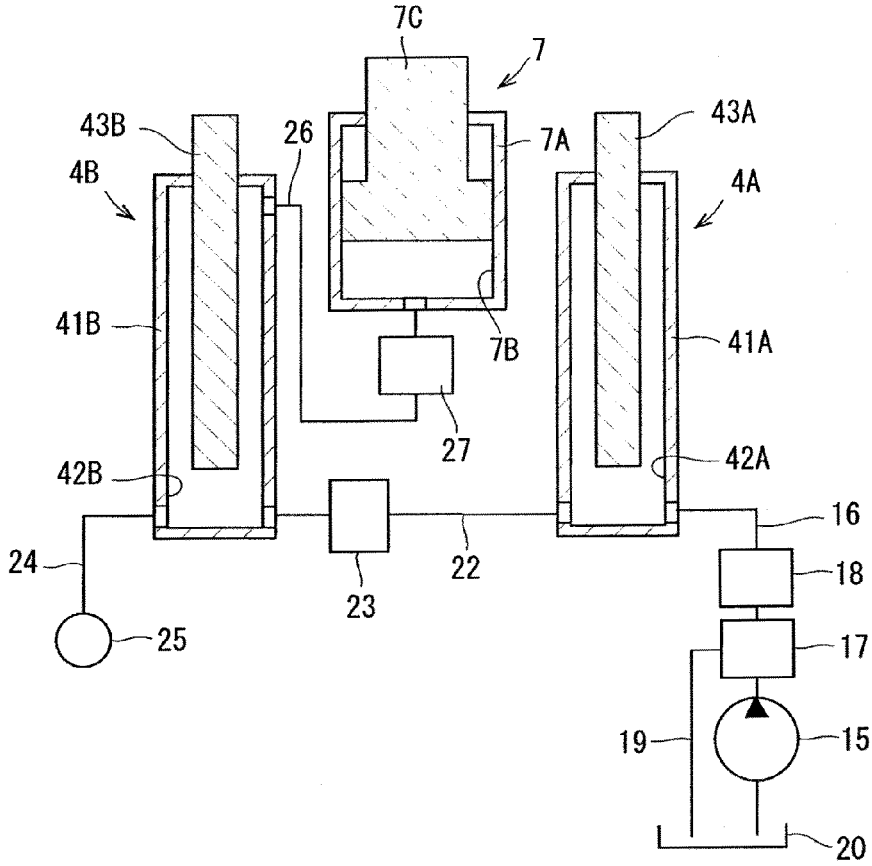
FIG. 5 is a schematic view of a lift cylinder unit and its related parts in forklift truck of FIG. 1.

As shown in FIG. 4, a lift cylinder unit has a pair of first lift cylinders 4A, 4B (only one lift cylinder being shown) disposed adjacent to the bottom ends of the paired outer masts 3A, respectively, and a second lift cylinder 7 disposed between the bottom ends of the inner masts 3B. As shown in FIG. 5, respective first lift cylinders 4A, 4B have first cylinder bodies 41A, 41B, first oil chambers 42A, 42B, and first piston rods 43A, 43B. The first cylinder bodies 41A, 41B have the first oil chambers 42A, 42B formed therein, and are fixed to the outer masts 3A through a lower tie beam 5A, respectively. As shown in FIGS. 2 through 4, the first piston rods 43A, 43B are fixed at the top thereof to the inner masts 3B through an upper tie beam 5B, and extendable from the first cylinder bodies 41A, 41B, respectively.

As shown in FIG. 5, the second lift cylinder 7 has a second cylinder body 7A, a second oil chamber 7B, and a second piston rod 7C. The second cylinder body 7A has the second oil chamber 7B formed therein, and is connected to the inner masts 3B through a middle tie beam 5C. The second piston rod 7C is extendable from the second cylinder body 7A. Chain wheels 9 (only one chain wheel being shown) are mounted to the top end of the second piston rod 7C as shown in FIGS. 2 through 4.

A pair of chains 14 is wound around the chain wheels 9, respectively. One end of respective chain 14 is fixed to the second cylinder body 7A, and the other end of the chains 14 is fixed to the lift bracket 6. A lift detecting switch 28 is disposed between the outer masts 3A and the inner masts 3B for detecting movement of the inner masts 3B away from the outer masts 3A. The lift detecting switch 28 serves as the detecting device of the present invention.

As shown in FIG. 5, a high-pressure hose 16 is connected at one end thereof to the outlet port of a hydraulic pump 15, and the other end thereof to the first oil chamber 42A of the first lift cylinder 4A. An oil control valve 17 and a flow regulator valve 18 are connected through the high-pressure hose 16 in this order as viewed from the side of the hydraulic pump 15. A drain hose 19 is connected to the oil control valve 17. The hydraulic pump 15 is driven by an engine E shown in FIG. 1 for pumping hydraulic oil from an oil tank 20 shown in FIG. 5. The oil control valve 17 is operable to selectively supply hydraulic oil to the FV mast assembly 3 or tilting hydraulic cylinders 21 shown in FIG. 1. The flow regulator valve 18 regulates the maximum flow rate of hydraulic oil.

The first oil chambers 42A, 42B of the first lift cylinders 4A, 4B are connected to each other through a high-pressure hose 22. A safety down valve 23 is disposed in the first oil chamber 42B of the first lift cylinder 4B. A high-pressure hose 24 is connected at one end thereof to the first oil chamber 42B of the first lift cylinder 4B and at the other end thereof to a pressure sensor 25. The high-pressure hoses 16, 22, 24 form the main oil passage of the present invention.

A high-pressure hose 26 is connected at one end thereof to the first oil chamber 42B of the first lift cylinder 4B, and at the other end thereof to the second oil chamber 7B of the second lift cylinder 7. A safety down valve 27 is disposed in the second oil chamber 7B of the second lift cylinder 7. The high-pressure hose 26 forms the sub oil passage of the present invention.

Therefore, the first oil chambers 42A, 42B of the first lift cylinders 4A, 4B of the first stage and the second oil chamber 7B of the second lift cylinder 7 of the second stage are connected in series from the flow regulator valve 18 toward the downstream in such a way that the second oil chamber 7B of the second lift cylinder 7 is located downstream of the first oil chambers 42A, 42B of the first lift cylinders 4A, 4B with respect to the flowing direction of hydraulic oil.

The rod diameter of the first lift cylinders 4A, 4B, or the first cylinder bodies 41A, 41B is represented by ϕ high (cm), and the inner diameter of the second lift cylinder 7, or the second cylinder body 7A is represented by ϕ low (cm), respectively. The rod diameter of the first lift cylinders 4A, 4B and the inner diameter of the second lift cylinder 7 are set such that the second lift cylinder 7 is firstly actuated thereby to extend its second piston rod 7C against the weight of a load acting on the lift cylinders and the weight of the inner masts and the lift bracket and the like. Thus, when the oil control valve 17 supplies hydraulic oil to the FV mast assembly 3, the second lift cylinder 7 having the second oil chamber 7B of the second or lowermost stage firstly extends its second piston rod 7C.

Figure 6:
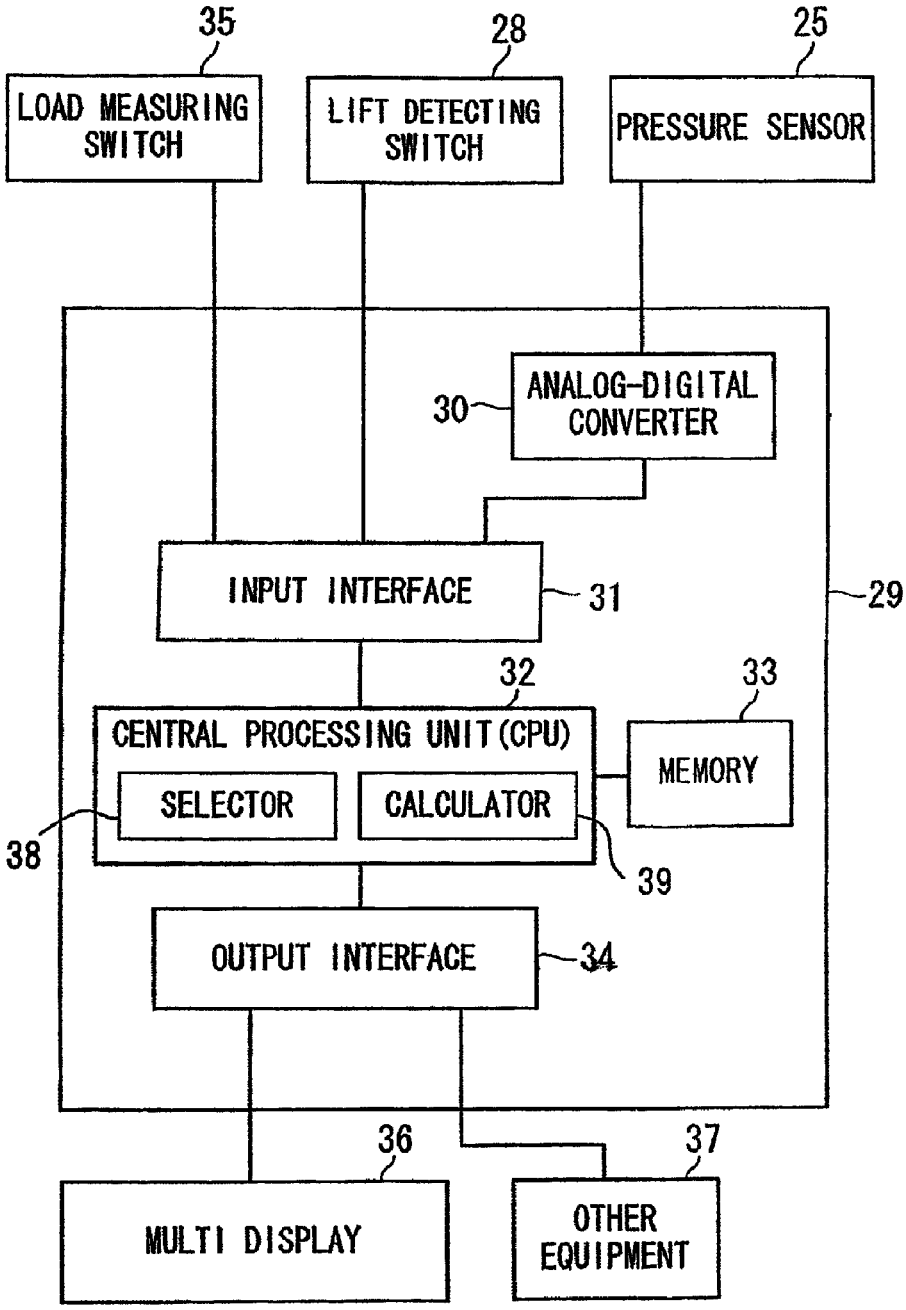
FIG. 6 is a block diagram showing the arrangement of a controller and its related parts in the forklift truck of FIG. 1.

Referring to FIG. 1, a steering wheel 11, a lift lever 12, and a tilt lever 13 are arranged in the front of a driver's cabin 10. A controller 29 is fixed to the body frame 2. As shown in FIG. 6, the controller 29 has an analog-digital converter 30, an input interface 31, a central processing unit (CPU) 32, a memory 33 and an output interface 34.

A load weight measuring switch 35, a lift detecting switch 28, a pressure sensor 25, a multi display 36 and other equipment 37 are connected to the controller 29. The load weight measuring switch 35 and the lift detecting switch 28 are connected to the input interface 31 of the controller 29, and the pressure sensor 25 is connected to the input interface 31 of the controller 29 through the analog-digital converter 30. The input interface 31, the memory 33, and the output interface 34 are connected to the CPU 32, and the multi display 36 and the other equipment 37 are connected to the output interface 34. The other equipment 37 includes an oil control valve 81, the engine E, and the like. The load weight measuring switch 35 and the multi display 36 are located in the driver's cabin 10.

The memory 33 has various memories such as a read only memory (ROM), a random access memory (RAM), and an electrically erasable and programmable read only memory (EEPROM). The memory 33 stores a parameter of sensitivity S (kg/cm2/V) of the pressure sensor 25 and other parameters shown in Tables 2, 3, and equations (1), (2) below. The parameters shown in Tables 2, 3 and equations (1), (2) are shared in common by various mast assemblies of FSV, FSW, FV, FW and V mast assembles.

$$Wcyl=S\times\pi(\phi/2)^2\times(Vp-V0) \quad (1)$$

$$Wp=Wcyl\times Ncyl+Np \quad (2)$$

TABLE 2

| Mast assembly type | Pressure sensor | ϕ (cm) | Ncyl | Np |
|---|---|---|---|---|
| FV | V0 low | ϕ low | 1 | 2 |
| FW | V0 low | ϕ low | 2 | 2 |
| FSV | V0 low | ϕ low | 1 | 2 |
| FSW | V0 low | ϕ low | 2 | 2 |
| V | V0 low | ϕ low | 2 | 2 |

TABLE 3

| Mast assembly type | Pressure sensor | ϕ (cm) | Ncyl | Np |
|---|---|---|---|---|
| FV | V0 high | ϕ high | 2 | 1 |
| FW | V0 high | ϕ high | 2 | 1 |
| FSV | V0 high | ϕ high | 2 | 2 |
| FSW | V0 high | ϕ high | 2 | 2 |
| V | V0 high | ϕ high | 2 | 2 |

Table 2 shows parameters for the low lift state where the lift bracket 6 is raised relative to the inner masts 3B. Table 3 shows parameters for the high lift state where the lift bracket 6 is further raised after the lift bracket 6 is fully raised relative to the inner masts 3B in the low lift state. In Tables 1 and 2, V0 (V) represents zero point voltage of the pressure sensor 25, V0 low represents zero point voltage in the low lift state, and V0 high represents zero point voltage in the high lift state. ϕ (cm) represents the inner or rod diameter of the first and second lift cylinders 4A, 4B, 7, and ϕ high represents the rod diameter of the first cylinder bodies 41A, 41B, and ϕ low represents the inner diameter of the second cylinder body 7A. Ncyl, which represents the pressure sensing area factor, equals one when one lift cylinder supports the load weight, and equals two when two lift cylinders support the load weight. Furthermore, Np, which represents the correction value indicating how many times of effective load weight is applied, equals one when a load weight W is applied to the lift cylinders of the FV or FW mast assembly in the high lift state, and equals two when a load weight 2 W, or twice the load weight W, is applied to the lift cylinders of the FSV, FSW, or V mast assembly in the high lift state.

Figure 7:
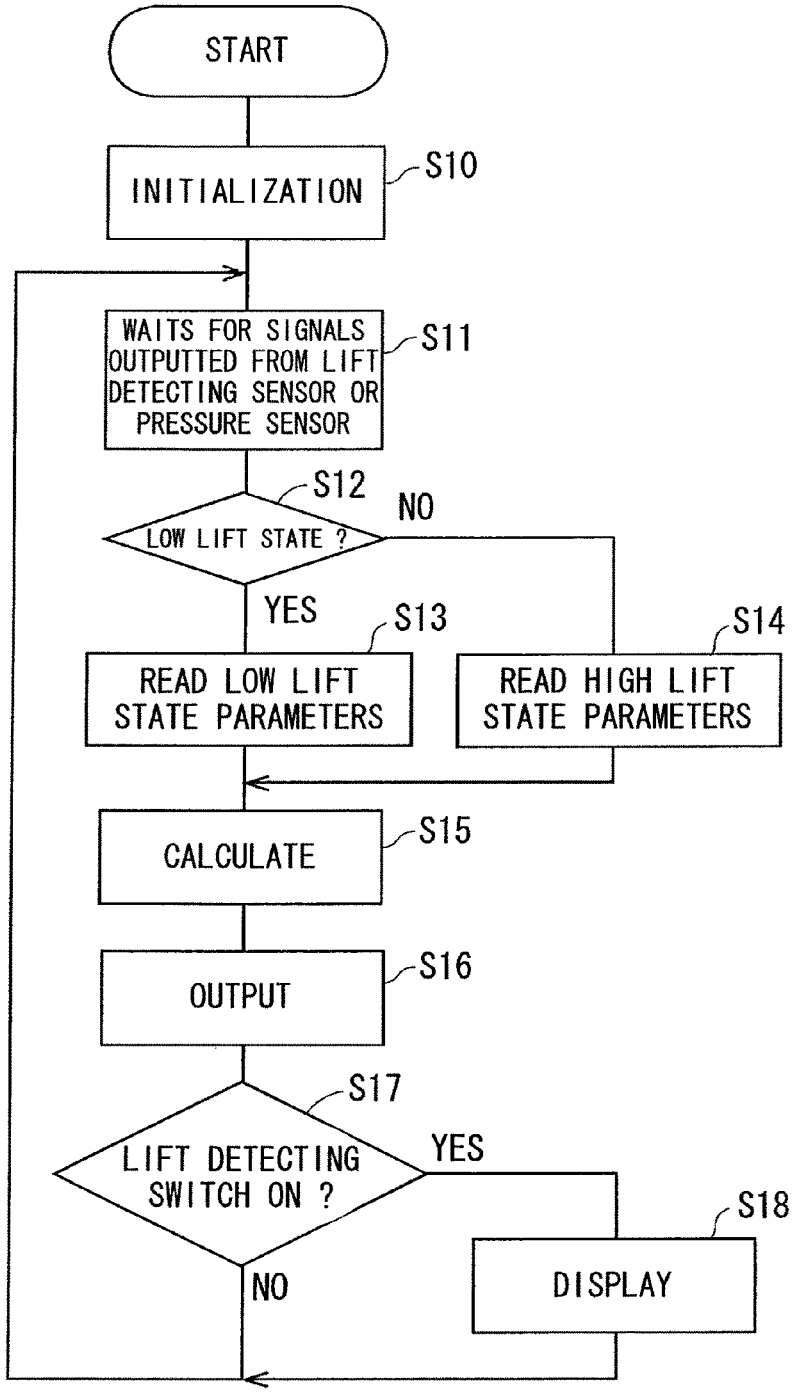
FIG. 7 is a flow chart showing the operation of the forklift truck of FIG. 1.

The memory 33 stores a program for executing a process represented by the flow chart shown in FIG. 7, and the CPU 32 runs the program.

In the above-described forklift truck 1 which is in a state shown in FIG. 2, when the lift lever 12 of the forklift truck 1 in the state of FIG. 2 is operated by the operator, hydraulic oil discharged from the hydraulic pump 15 shown in FIG. 5 is supplied to the oil control valve 17, and then to the flow regulator valve 18. Hydraulic oil is supplied further to the second oil chamber 7B of the second lift cylinder 7 through the first oil chamber 42A of the first lift cylinder 4A, the high-pressure hose 22, the first oil chamber 42B of the first lift cylinder 4B, and the high-pressure hose 26. Accordingly, the second piston rod 7C of the second lift cylinder 7 is extended before the first piston rods 43A, 43B of the first lift cylinders 4A, 4B are extended because of the aforementioned setting of the rod diameters and the inner diameters thereof.

As shown in FIG. 3, the lift bracket 6 is raised to the level of the top end of the inner masts 3B, but the inner masts 3B are at their lower position without being raised relative to the outer masts 3A. The forklift truck 1 in this low lift state can be used in a place whose ceiling is not sufficiently high without a collision between the FV mast assembly 3 and the ceiling.

When hydraulic oil is further supplied, the first piston rods 43A, 43B of the first lift cylinders 4A, 4B are extended, so that the inner masts 3B are raised to the level of the top end of the outer masts 3A as shown in FIG. 4. Thus, the FV mast assembly 3 is placed in the high lift state. When the FV mast assembly 3 changes from the low lift state to the high lift state, the inner masts 3B are moved away from the outer masts 3A, so that the lift detecting switch 28 outputs a detection signal to the controller 29.

As shown in FIG. 5, when the FV mast assembly 3 is in the low or high lift state, the load weight acting on the lift bracket 6 is transmitted to the hydraulic oil in the first oil chambers 42A, 42B of the first lift cylinders 4A, 4B through the hydraulic oil in the second oil chamber 7B of the second lift cylinder 7. The pressure in the high-pressure hose 24 is applied to the pressure sensor 25.

In the meantime, the controller 29 performs the following steps in the forklift truck 1, as shown in FIG. 7. Turning an ignition key, the CPU 32 performs initialization in the step S10, and then waits for signals outputted from the lift detecting switch 28, and the pressure sensor 25 in the step S11. Depending on a detection signal outputted from the lift detecting switch 28, it is determined whether the FV mast assembly 3 is in the low lift state or in the high lift state in the step S12.

If YES, or if it is determined that the FV mast assembly 3 is the low lift state, the parameters for the FV mast assembly 3 in the low lift state are read from the ROM and stored in the RAM of the memory 33 in the step S13. On the other hand, if NO, or if it is determined that the FV mast assembly 3 is in the high lift state, the parameters for the FV mast assembly 3 in the high lift state are read from the ROM, and stored in the RAM of the memory 33 in the step 14. The steps S12, S13, S14 serve as a selector 38 of the present invention.

The CPU 32 calculates the values of the load weight Wcyl (kg) per one lift cylinder and the calculated load weight Wp (kg) based on the equations (1), (2), the parameters stored in the RAM, and the output voltage Vp (V) of the pressure sensor 25 in the step 15. The step 15 serves as the calculator 39 of the present invention.

The calculated load weight is transmitted to the other equipment 37 in the step S16 for providing a warning if the calculated load weight exceeds a predetermined value, or controlling the forward-tilting angle of the FV mast assembly 3 or the traveling speed of the forklift truck, and the like. It is determined whether the load weight measuring switch 35 is turned on or not by the operator in the step 17. If YES, or if the load weight measuring switch 35 is turned on, the value of the calculated load weight is displayed on the multi display 36. If NO, or if the load weight measuring switch 35 is not turned on, the controller returns to the step S11 and repeats the above-described steps.

For example, assuming that the zero point voltage of the FV mast assembly 3 in the low lift state is 0.8 V, the zero point voltage in the high lift state is 1.0 V, the inner diameter ϕ low of the second cylinder body 7A is 7 cm, and the rod diameter ϕ high of the first cylinder bodies 41A, 41B is 3.2 cm, the output voltages Vp (V) of the pressure sensor 25, and the load weights (kg) are different between the low lift state and the high lift state of the mast assembly 3 as follows.

(In the Low Lift Height)

$$Wcyl \approx 50 \times 3.14 \times (7/2)^2 \times (Vp - 0.8) \approx 1924Vp - 1540 \quad \text{Equation (1)}$$

$$Wp = (1924Vp - 1540) \times 1/2 = 962Vp - 770 \quad \text{Equation (2)}$$

$$Vp \approx Wp/962 + 0.8$$

(In the High Lift Height)

$$Wcyl \approx 50 \times 3.14 \times (3.2/2)^2 \times (Vp - 1.0) \approx 402Vp - 402 \quad \text{Equation (1)}$$

$$Wp = (402Vp - 402) \times 2 \div 1 = 804Vp - 804 \quad \text{Equation (2)}$$

$$Vp \approx Wp/804 + 1.0$$

Figure 8:
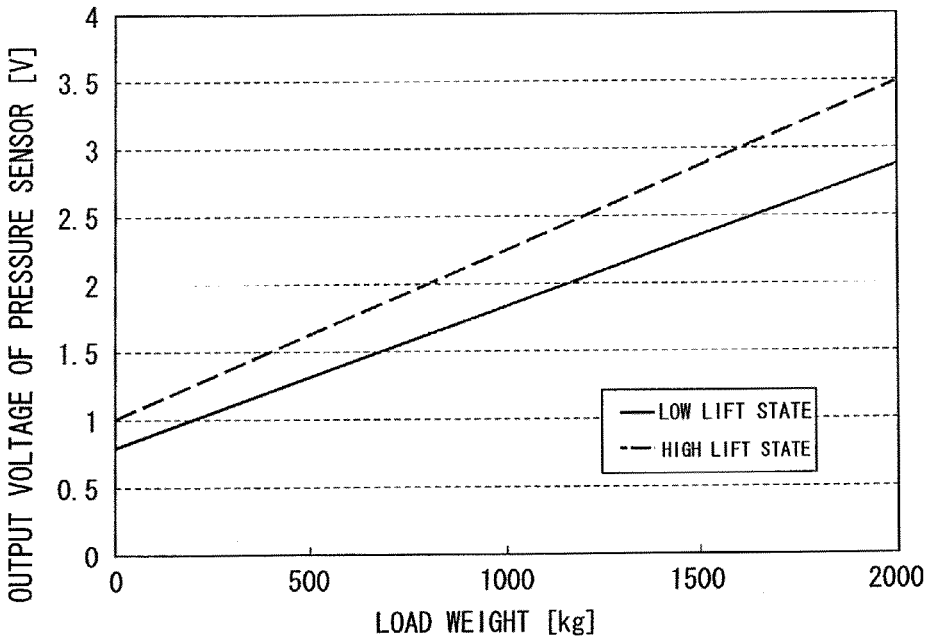
FIG. 8 is a graph showing a relation between the load weight and the electric voltage outputted from a pressure sensor of the forklift truck of FIG. 1.

The difference in the relation between the output voltage Vp (V) and the load weight (kg) between the low and high lift states is shown in FIG. 8. As understood from FIG. 8, the value of the load weight as calculated based on the output voltage Vp in the low lift state, though the FV mast assembly 3 is actually in the high lift state, is incorrect. Meanwhile, the value of the load weight as calculated based on the output voltage Vp in the high lift state is correct if the FV mast assembly 3 is actually in the high lift state.

Thus, the load weight measuring device of the FV mast assembly 3 of the forklift truck 1 can always measure the load weight correctly. Therefore, regardless of the lift height difference, the load weight measuring device according to the first preferred embodiment can display the value of the load weight on the multi display 36 correctly, provide the warning signal correctly, and perform the appropriate controlling.

Figure 9:
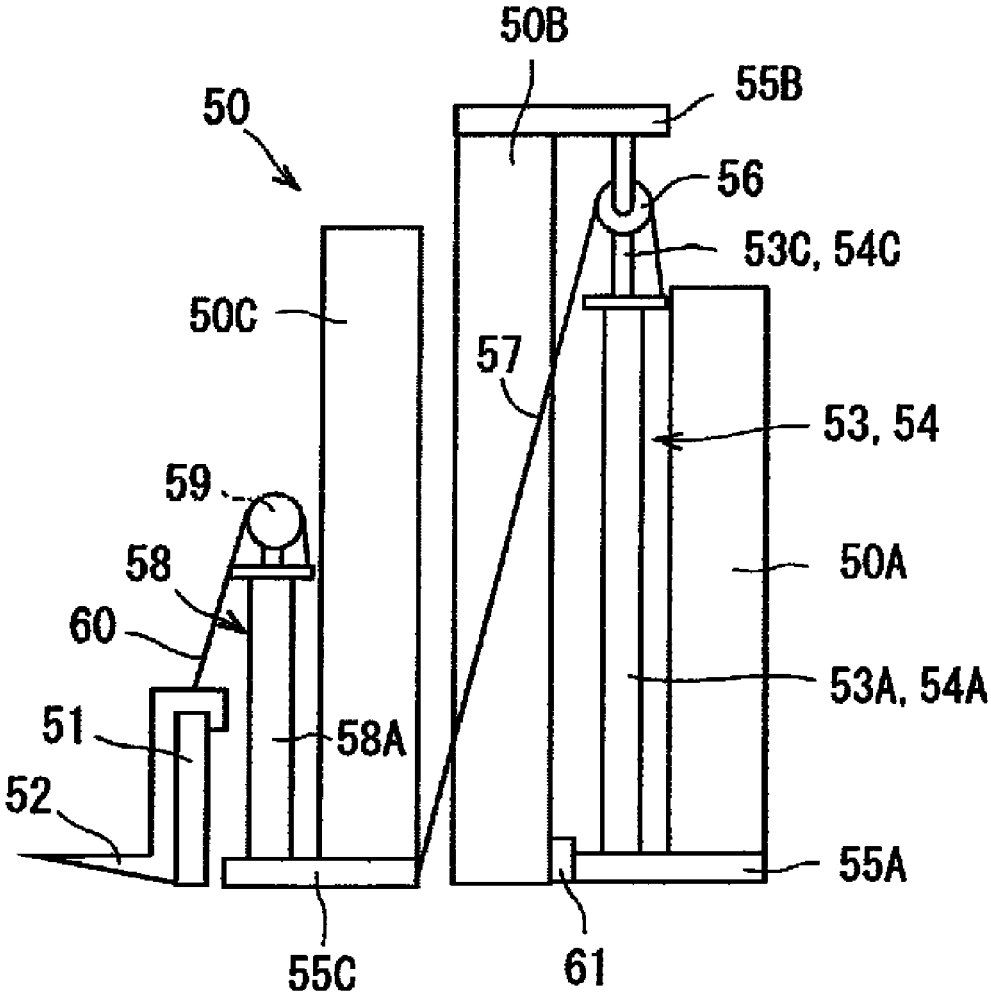
FIG. 9 is a schematic side view of a mast assembly of a forklift truck according to a second preferred embodiment of the present invention.
Figure 10:
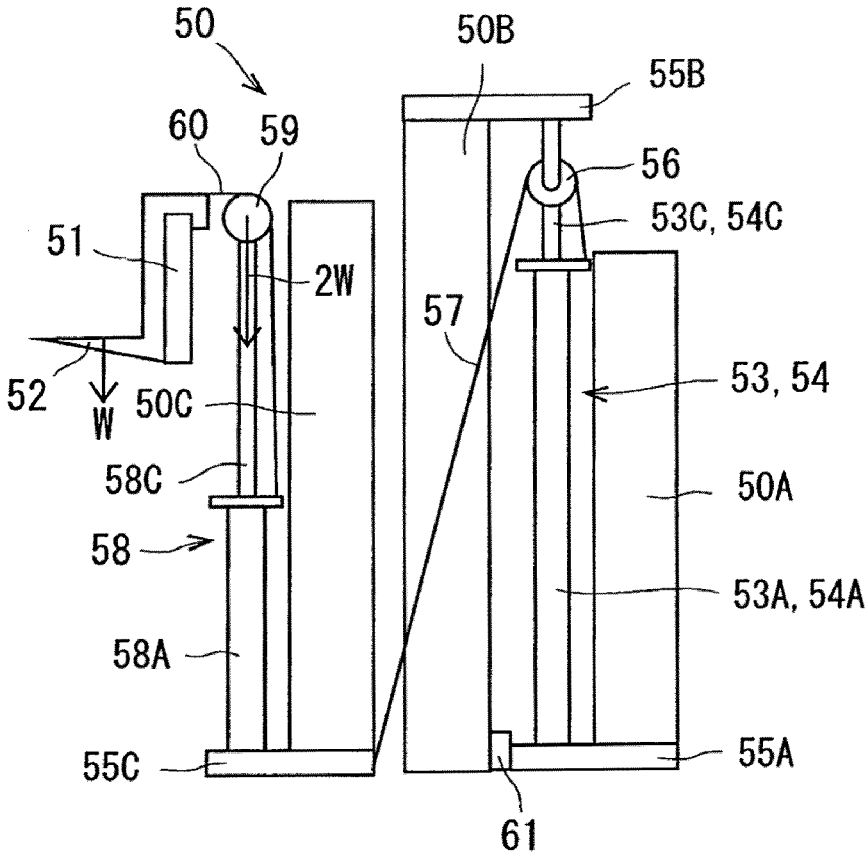
FIG. 10 is a schematic side view of the mast assembly in FIG. 9 in a different state.
Figure 11:
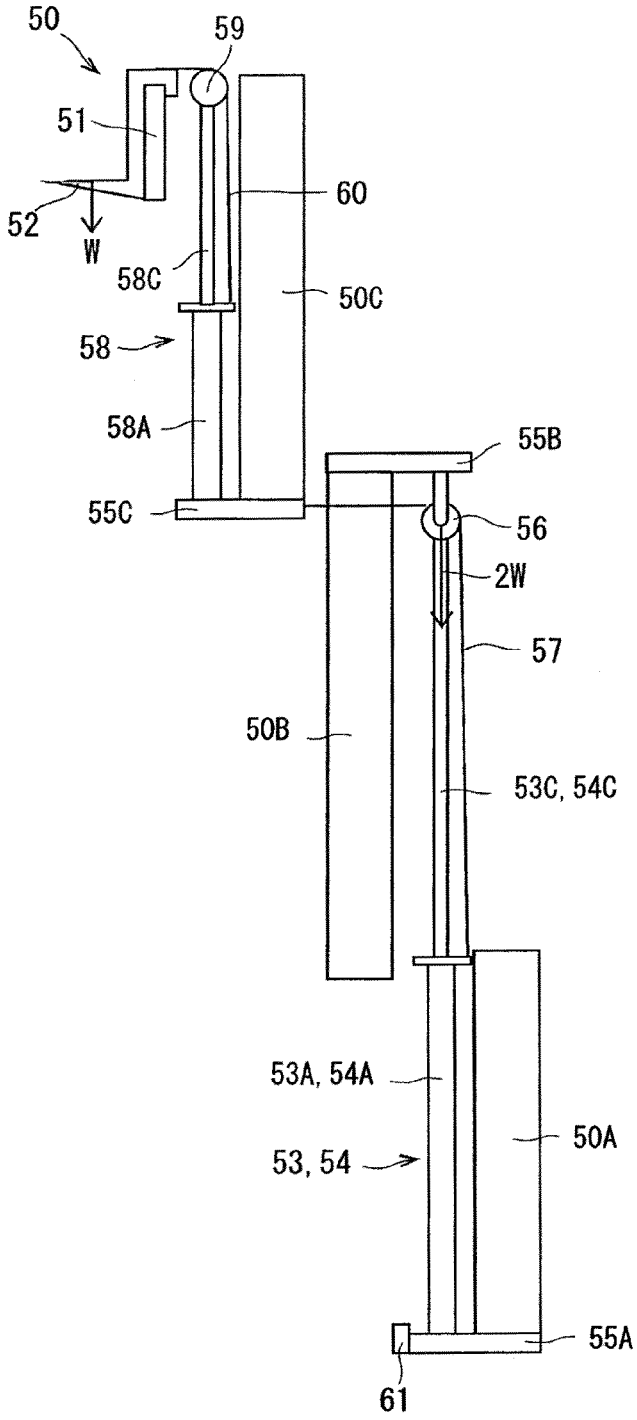
FIG. 11 is a schematic side view of the mast assembly in FIG. 9 in a still different state.

The following will describe the load weight measuring device of the forklift truck according to the second preferred embodiment of the present invention with reference to FIG. 9 through FIG. 13. The forklift truck according to the second preferred embodiment of the present invention has a body frame and a FSV mast assembly 50 disposed upright in the front of the body frame. Referring to FIGS. 9 through 11, the FV mast assembly 50 has a pair of left and right outer masts 50A, a pair of left and right middle masts 50B, and a pair of left and right inner masts 50C. Each outer mast 50A is supported tiltably in the longitudinal direction of the body frame, each middle mast 50B is guided for vertical movement by its corresponding outer mast 50A, and each inner mast 50C is guided for vertical movement by its corresponding middle mast 50B. The inner masts 50C guide a lift bracket 51 having a pair of left and right forks 52 for vertical movement.

Figure 12:
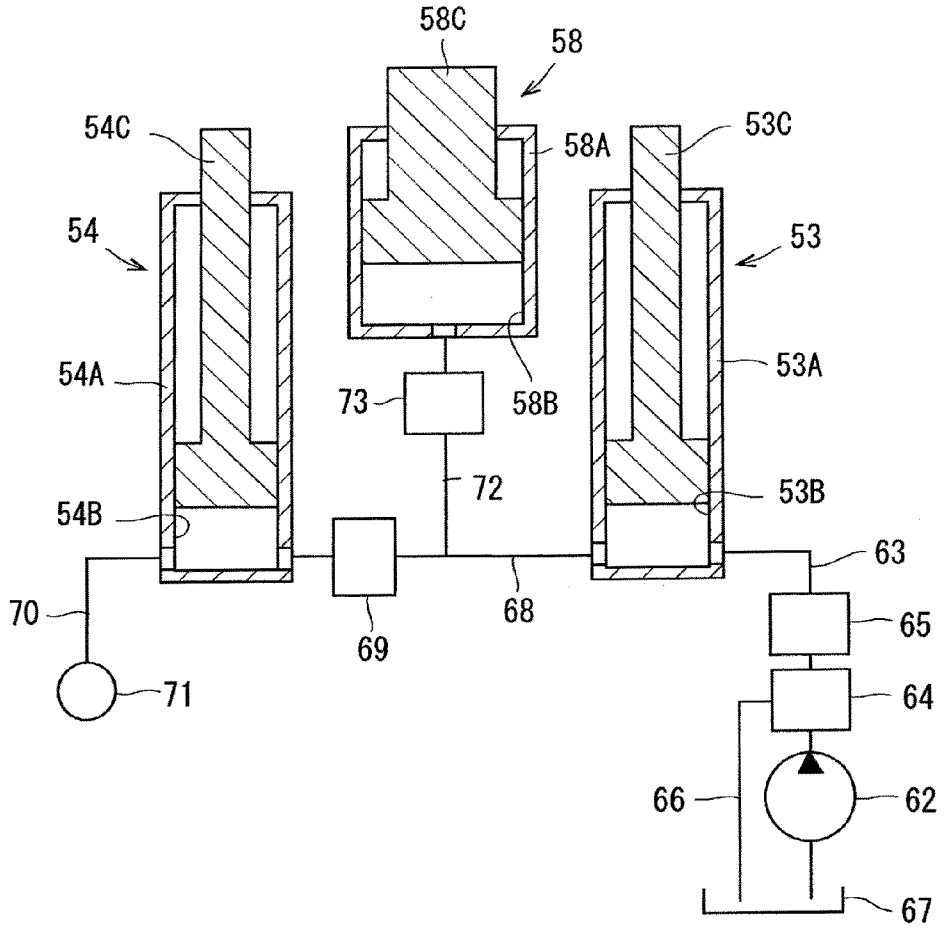
FIG. 12 is a schematic view of a lift cylinder unit and its related parts of the forklift truck of FIG. 9.

Referring to FIG. 12, a lift cylinder unit has a pair of first lift cylinders 53, 54 disposed adjacent to the bottom ends of the outer masts 50A, respectively, and a second lift cylinder 58 disposed between the bottom ends of the inner masts 50C. The first lift cylinders 53, 54 have first cylinder bodies 53A, 54A, first oil chambers 53B, 54B, and first piston rods 53C, 54C, respectively. The first cylinder bodies 53A, 54A have the first oil chambers 53B, 54B formed therein, and are fixed to the outer masts 50A through a lower tie beam 55A, respectively. As shown in FIGS. 9 through 11, the first piston rods 53C, 54C are fixed to the middle masts 50B at the top end thereof through a middle tie beam 55B, and extendable from the first cylinder bodies 53A, 54A, respectively. First chain wheels 56 (only one wheel being shown) are mounted to the middle tie beam 55B so as to depend therefrom.

First chains 57 (only one chain being shown) are wound around the corresponding first chain wheels 56. One end of respective first chains 57 are fixed to its corresponding first cylinder bodies 53A, 54A, and the other end of the first chains 57 is fixed to an inner mast lower beam 55C. A lift detecting switch 61 is disposed between the outer masts 50A and the middle masts 50B for detecting the movement of the middle masts 50B away from the outer masts 50A. The lift detecting switch 61 serves as the detecting device of the present invention.

As shown in FIG. 12, the second lift cylinder 58 has a second cylinder body 58A, a second oil chamber 58B, and a second piston rod 58C. The second cylinder body 58A has the second oil chamber 58B formed therein, and is fixed to the inner masts 50C through an inner mast lower beam 55C. The second piston rod 58C is extended from the second cylinder body 58A. A pair of second chain wheels 59 (only one second chain wheel being shown) is mounted to the top end of the second piston rod 58C, as shown in FIGS. 9 through 11.

A pair of second chains 60 (only one second chain being shown) is wound around the second chain wheels 59. One end of the second chains 60 is fixed to the second cylinder body 58A, and the other end of the second chains 60 is fixed to the lift bracket 51.

As shown in FIG. 12, a high-pressure hose 63 is connected at one end thereof to a hydraulic pump 62 at the outlet port thereof, and the other end thereof to the first oil chamber 53B of the first lift cylinder 53. An oil control valve 64 and a flow regulator valve 65 are connected through the high-pressure hose 63 in this order as seen from the side of the hydraulic pump 62. A drain hose 66 is connected to the oil control valve 64. The hydraulic pump 62 is driven by the engine E shown in FIG. 1 for pumping hydraulic oil from an oil tank 67 shown in FIG. 12.

The first oil chambers 53B, 54B of the first lift cylinders 53, 54 are in communication with each other through a high-pressure hose 68. A safety down valve 69 is disposed in the first oil chamber 54B of the first lift cylinder 54. A high-pressure hose 70 is connected at one end thereof to the first oil chamber 54B of the first lift cylinder 54, and the other end thereof to a pressure sensor 71. The high-pressure hoses 63, 68, 70 form the main oil passage of the present invention.

A high-pressure hose 72 is branched from the high-pressure hose 68, and connected to the second oil chamber 58B of the second lift cylinder 58. A safety down valve 73 is disposed in the second oil chamber 58B. The high-pressure hose 72 forms the sub oil passage of the present invention.

The first oil chambers 53B, 54B of the first lift cylinders 53, 54 of the first stage and the second oil chamber 58B of the second lift cylinder 58 of the second stage are connected in series from the flow regulator valve 65 toward the downstream in such a way that the second oil chamber 58B of the second lift cylinder 58 is located down stream of the first oil chambers 53B, 54B of the first lift cylinders 53, 54 with respect to the flowing direction of hydraulic oil from the flow regulator valve 65.

The rod diameter of the first lift cylinders 53, 54, or the rod diameter of the first cylinder bodies 53A, 54A is represented by $\phi$ high (cm). The inner diameter of the second lift cylinder 58, or the inner diameter of the second cylinder body 58A is represented by $\phi$ low (cm). The rod diameter of the first lift cylinders 53, 54, and the inner diameter of the second lift cylinder 58 is set so that the second lift cylinder 58 is firstly actuated thereby to extend its second piston rod 58C against the weight of a load acting on the lift cylinders, and the weight of the inner masts and the lift bracket, and the like. Thus, when the oil control valve 64 supplies hydraulic oil to the FSV mast assembly 50, the second lift cylinder 58 having the second oil chamber 58B of the second or lowermost stage firstly extends its second piston rod 58C. The second preferred embodiment of the present invention differs from the first preferred embodiment in that the program executed by the CPU is modified. The rest of the structure is substantially the same as the first preferred embodiment.

In the above-described forklift truck, when the lift lever of the forklift truck in the state of FIG. 9 is operated by the operator, hydraulic oil discharged from the hydraulic pump 62 shown in FIG. 12 is supplied to the oil control valve 64, and then to the flow regulator valve 65. Hydraulic oil is supplied further to the second oil chamber 58B of the second lift cylinder 58 through the first oil chamber 53B of the first lift cylinder 53, the high-pressure hose 68, the first oil chamber 54B of the first lift cylinder 54, and the high-pressure hose 72. Accordingly, the second piston rod 58C of the second lift cylinder 58 is extended before the first piston rods 53C, 54C of the first lift cylinders 53, 54 are extended because of the aforementioned setting of the rod diameters and the inner diameters thereof.

Thus, the lift bracket 51 is raised to the level of the top ends of the inner masts 50C, but the inner masts 50C are at their lowered position without being raised relative to the middle masts 50B, as shown in FIG. 10.

When hydraulic oil is further supplied, the first piston rods 53C, 54C of the first lift cylinders 53, 54 are extended, as shown in FIG. 11, so that the inner masts 50C are raised to the level of the top ends of the middle masts 50B, and the middle masts 50B are raised to the level of the top end of the outer masts 50A. Thus, the FSV mast assembly 50 is placed in its high lift state. When the FSV mast assembly 50 changes from the low lift state to the high lift state, the inner masts 50C are moved away from the outer masts 50A. Accordingly, the lift detecting switch 61 outputs a detection signal to the controller.

As shown in FIG. 12, when the FSV mast assembly 50 is in the low or high lift state, the load weight acting on the lift bracket 51 is transmitted to the hydraulic oil in the first oil chambers 53B, 54B of the first lift cylinders 53, 54 through the hydraulic oil in the second oil chamber 58B of the second lift cylinder 58. The pressure in the high-pressure hose 70 is applied to the pressure sensor 71.

When it is determined that the FSV mast assembly 50 is in the low lift state, the controller reads the parameters for the FSV mast assembly 50 in the low lift state. Meanwhile, when it is determined that the FSV mast assembly 50 is in the high state, the controller reads the parameters for the FSV mast assembly 50 in the high lift state.

The load weight acting on the lift bracket 51 is calculated, and then the value of the calculated load weight is displayed on the multi-display through steps similar to the above-described steps for the first preferred embodiment of the present invention. The data of the calculated load weight is used for providing a warning signal when the calculated load weight exceeds a predetermined value, and controlling of the forward-tilting angle of the FSV mast assembly 50 and the traveling speed of the forklift truck, and the like.

The output voltage Vp (V) of the pressure sensor 71 and the load weight (kg) are calculated on the same assumption as in the case of the first preferred embodiment.

(In the Low Lift State)

$$Wcyl \approx 50 \times 3.14 \times (7/2)^2 \times (Vp - 0.8) \approx 1924Vp - 1540 \quad \text{Equation (1)}$$

$$Wp = (1924Vp - 1540) \times 1/2 = 962Vp - 770 \quad \text{Equation (2)}$$

$$Vp \approx Wp/962 + 0.8$$

(In the High Lift State)

$$Wcyl \approx 50 \times 3.14 \times (3.2/2)^2 \times (Vp - 1.0) \approx 402Vp - 402 \quad \text{Equation (1)}$$

$$Wp = (795Vp - 795) \times 2 \div 2 = 402Vp - 402 \quad \text{Equation (2)}$$

$$Vp \approx Wp/402 + 1.0$$

Figure 13:
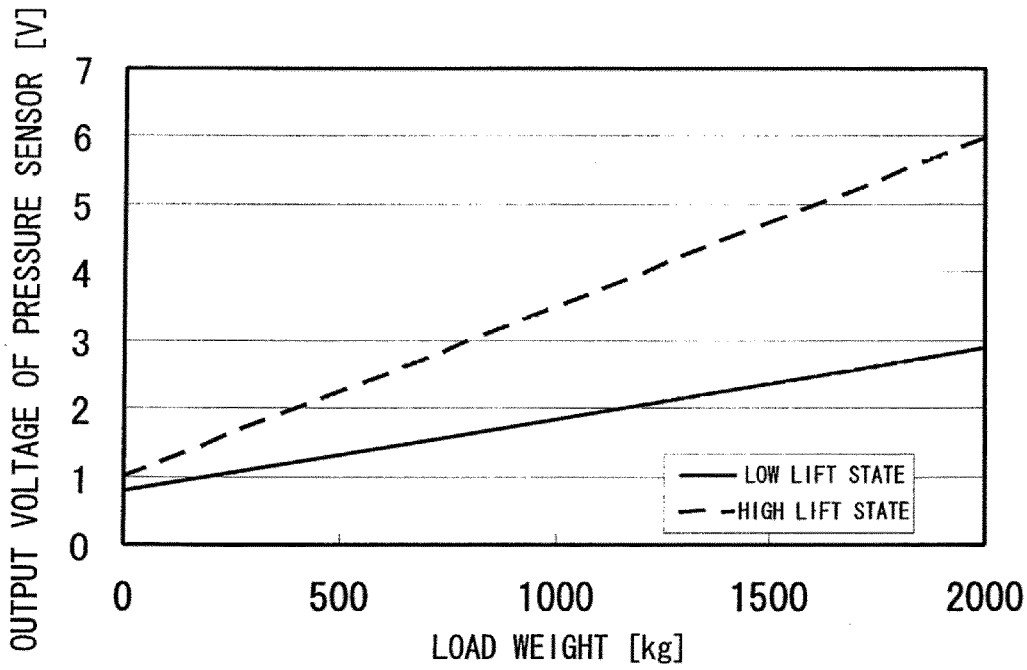
FIG. 13 is a graph showing a relation between the load weight and the electric voltage outputted from a pressure sensor of the forklift truck of FIG. 9.

FIG. 13 shows the difference in the relation between the output voltage Vp (V) and the load weight (kg) between the low lift state and the high lift state.

According to the load weight measuring device of the second preferred embodiment, the same advantageous effects as the first preferred embodiment can be obtained. The second embodiment can be accomplished merely by adding slight modifications to the program used in the first preferred embodiment and executed by the CPU, and data including the parameters, the equations and program stored in the memory can be shared in common by the load weight measuring devices of the first and second preferred embodiments of the present invention. Thus, it is not necessary to prepare a memory and a calculator for each type of mast assembly.

The present invention is not limited to the above-described first and second preferred embodiments, but may be modified, for example, into the following alternative embodiments.

Figure 14:
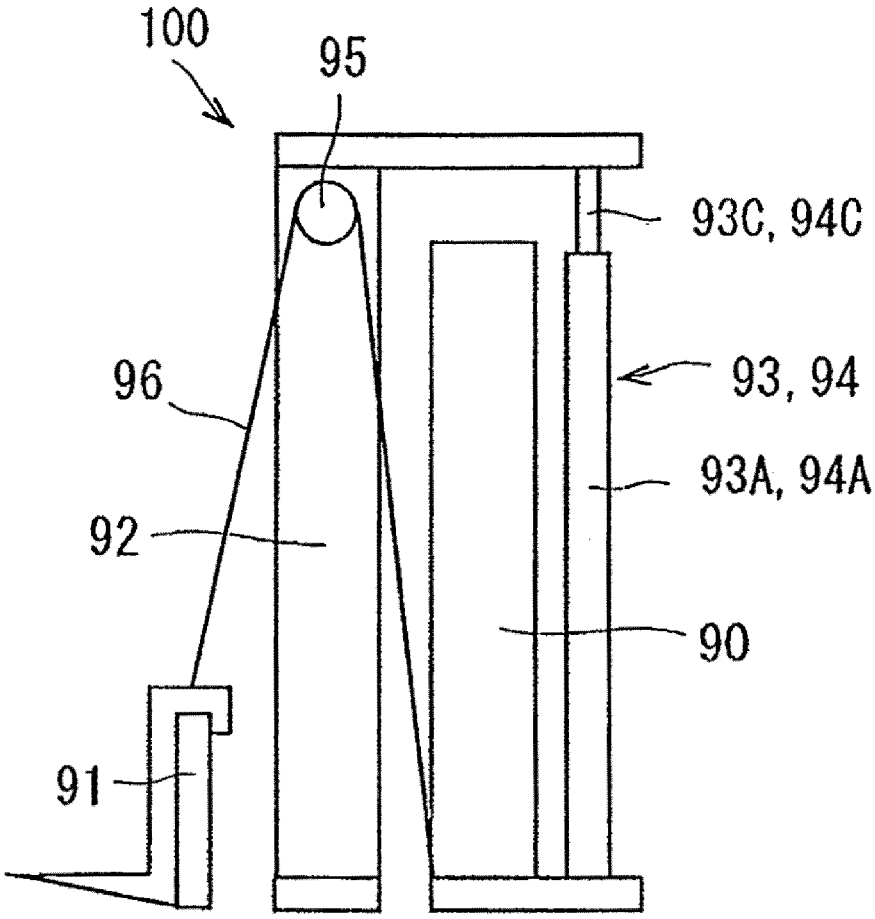
FIG. 14 (PRIOR ART)
FIG. 14 is a schematic side view of the mast assembly of the forklift truck according to the background art.
Figure 15:
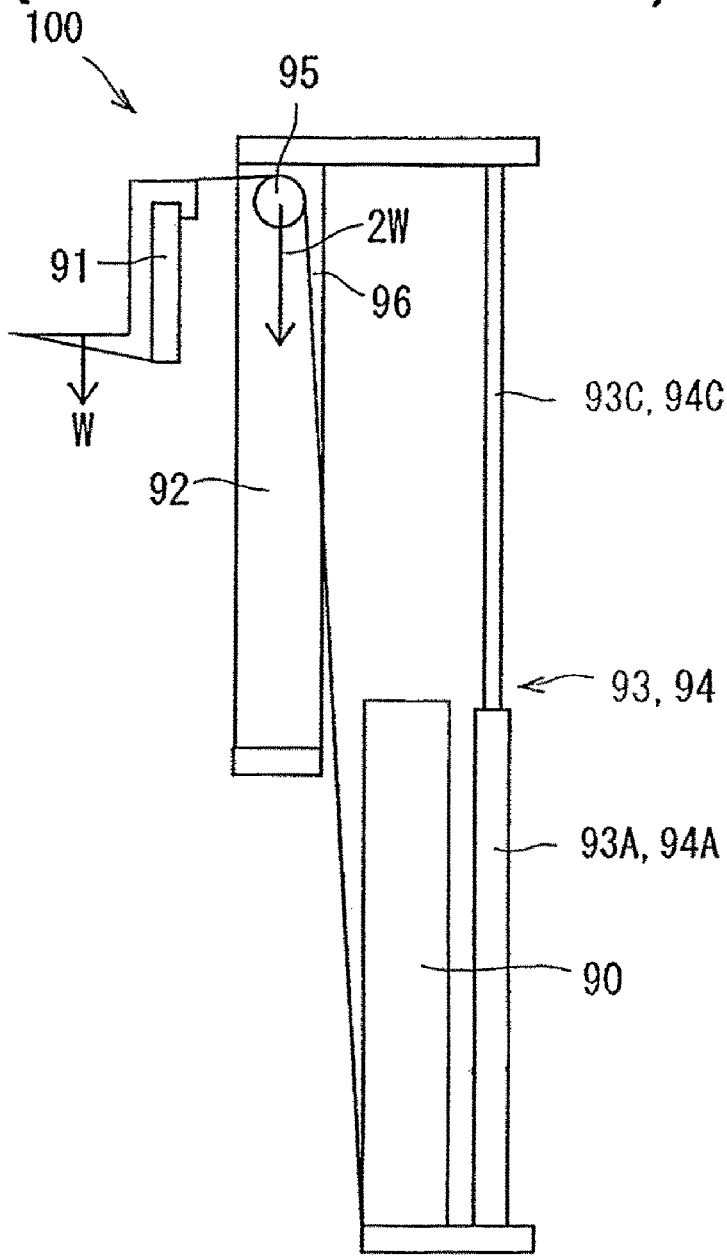
FIG. 15 (PRIOR ART)
FIG. 15 is a schematic side view of the mast assembly of FIG. 14.
Figure 16:
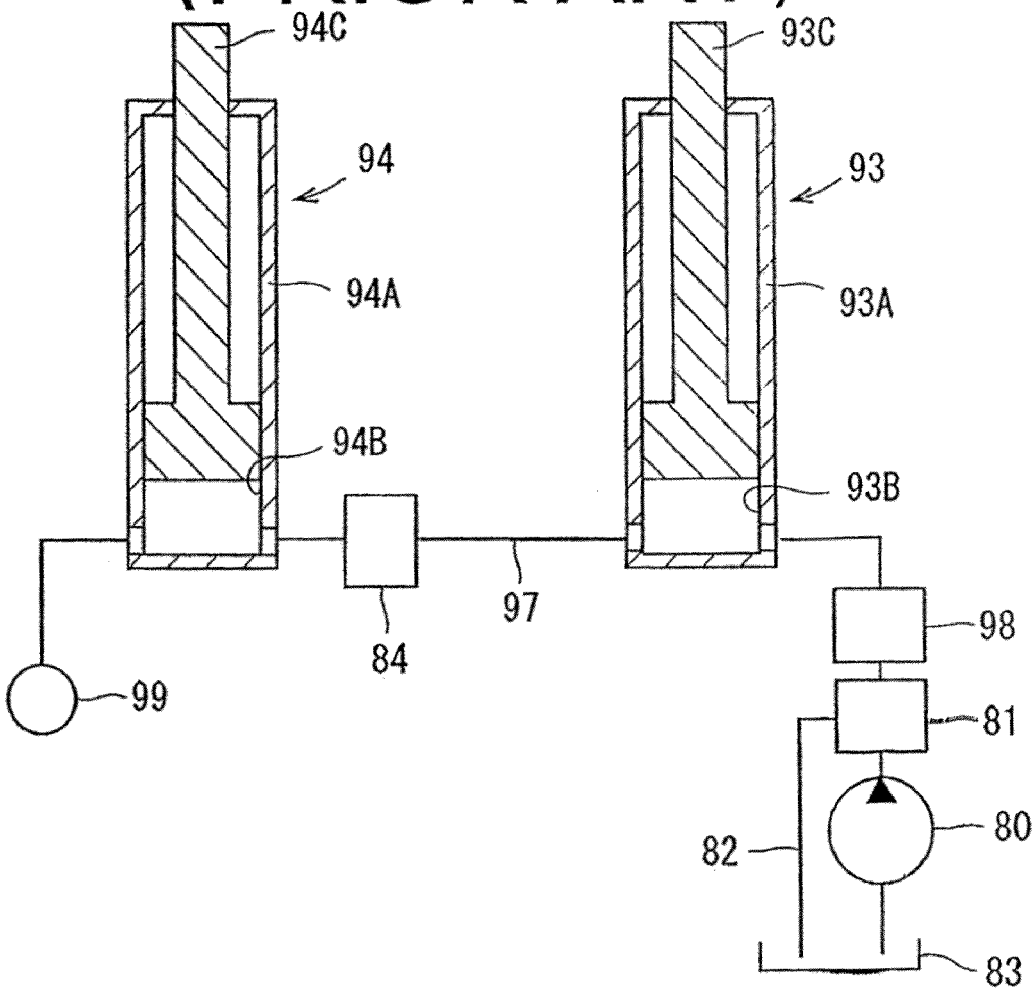
FIG. 16 (PRIOR ART)
FIG. 16 is a schematic view of a lift cylinder unit and its related parts of the forklift truck according to the background art.

The mast assembly of the present invention is not limited to the full free mast assembly used in the forklift truck as described with reference to the first and second preferred embodiment. Alternatively, the load weight measuring device is applicable to the V mast assembly shown in FIGS. 14 through 16. In such a case, the data including the parameters, the equations and the program used in the first and second preferred embodiments of the present invention may be shared in common.

In case when the full free mast device is used in the present invention, the mast assembly of the present invention is not limited to the FV mast assembly or FSV mast assembly, but, the FW mast assembly and the FSW mast assembly may be used alternatively.

Therefore, the present examples and embodiments are to be considered as illustrative and not restrictive, and the invention is not to be limited to the details given herein but may be modified within the scope of the appended claims.

What is claimed is:

1. A load weight measuring device for measuring the weight of a load while the load is being lifted by a multi-stage mast forklift truck comprising:

a mast assembly having:

a lift bracket for receiving a load weight;

a multi-stage mast unit having masts; and a multi-stage lift cylinder unit raising the lift bracket along the masts, the multi-stage lift cylinder unit having lift cylinders each having an oil chamber;

an oil passage in which hydraulic oil flows;

a flow regulator valve regulating the maximum flow rate of hydraulic oil, the flow regulator valve connected to one of the oil chambers of the multi-stage lift cylinder unit through the oil passage;

a pressure sensor detecting a pressure of hydraulic oil and outputting a pressure signal;

a detecting device detecting which stage of the multi-stage lift cylinder unit is raising the lift bracket and outputting a detection signal;

a memory storing predetermined parameters corresponding to the stages;

a selector selecting one or more parameters corresponding to the stages from the predetermined parameters based on the detection signal; and a calculator calculating the load weight based on the selected parameter and the pressure signal.

2. The load weight measuring device according to claim 1, wherein the oil chambers of the lift cylinder of each stage are connected in series from the flow regulator valve toward the downstream with respect to the flowing direction of hydraulic oil, wherein each lift cylinder further has a piston rod, and the lift cylinder of a stage at the most downstream firstly extends the piston rod thereof during a lifting operation.

3. The load weight measuring device according to claim 2, wherein after the lift cylinder of the stage at the downstream fully extends the piston rod thereof, the lift cylinders of another stage extend the piston rods thereof due to further supplied hydraulic oil.

4. The load weight measuring device according to claim 3, wherein the oil passage has a main oil passage and a sub oil passage in which hydraulic oil flows, wherein the masts have outer masts supported by a body frame, and inner masts vertically guided by the outer masts for vertically guiding and moving the lift bracket, wherein the multi-stage lift cylinder unit has a plurality of first lift cylinders and a second lift cylinder, wherein each first lift cylinder has (i) a first cylinder body fixed to each outer mast, (ii) a first oil chamber which is in communication with the flow regulator valve through the main oil passage, the first oil chamber formed in the first cylinder body, and (iii) a first piston rod which is extendable from the first cylinder body, the first piston rod fixed to the inner masts, wherein the second lift cylinder has (i) a second cylinder body fixed to the inner masts, (ii) a second oil chamber which is in communication with the first oil chamber through the sub oil passage, the second oil chamber formed in the second cylinder body, the second oil chamber located at the downstream of the first oil chamber, and (iii) a second piston rod which is extendable from the second cylinder body, and wherein a chain wheel is mounted to the end of the second piston rod, and a chain is wound around the chain wheel, one end of the chain is fixed to inner masts or the second cylinder body, and the other end of the chain is fixed to the lift bracket.

5. The load weight measuring device according to claim 4, wherein the detecting device is a lift detecting switch for detecting movement of the inner masts away from the outer masts.

6. The load weight measuring device according to claim 3, wherein the parameters include an inner or rod diameter of the lift cylinder represented by $\phi$, a zero point voltage of the pressure sensor represented by V0, a pressure sensing area factor represented by Ncyl, a correction value represented by Np which indicates how many times of the load weight is applied, and a sensitivity of the pressure sensor represented by S, wherein the calculator calculates the load weight represented by Wp with equations (1), (2), wherein the Vp represents an output voltage outputted from the pressure sensor, the Wcyl represents a load weight per one lift cylinder, the Wp represents a calculated load weight:

$$Wcyl = S \times \pi(\phi/2)^2 \times (Vp - V0) \quad (1)$$

$$Wp = Wcyl \times Ncyl \div Np \quad (2).$$

7. The load weight measuring device according to claim 1, further comprising a display on which the value of the calculated load weight is displayed.

* * * * *